US008777228B2

(12) United States Patent
Adamek

(10) Patent No.: US 8,777,228 B2
(45) **Date of Patent: *Jul. 15, 2014**

(54) METAL SEALING ADJUSTABLE CASING SUB

(75) Inventor: Frank C. Adamek, Pasadena, TX (US)

(73) Assignee: Vetco Gray Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/435,836

(22) Filed: Mar. 30, 2012

(65) Prior Publication Data

US 2012/0187634 A1 Jul. 26, 2012

Related U.S. Application Data

(62) Division of application No. 12/171,051, filed on Jul. 10, 2008, now Pat. No. 8,167,312.

(51) Int. Cl.
*E21B 33/02* (2006.01)

(52) U.S. Cl.
USPC ..... 277/343; 277/322; 166/344

(58) Field of Classification Search
USPC ..... 277/337, 338, 340, 615, 652, 653; 166/344, 348, 367, 355
See application file for complete search history.

(56) References Cited

U.S. PATENT DOCUMENTS

| | | | | |
|---|---|---|---|---|
| 4,408,784 | A | | 10/1983 | Reimert |
| 4,573,714 | A | | 3/1986 | Sweeney |
| 4,595,053 | A | | 6/1986 | Watkins et al. |
| 4,665,979 | A | | 5/1987 | Boehm, Jr. |
| 4,757,860 | A | | 7/1988 | Reimert |
| 4,790,572 | A | | 12/1988 | Slyker |
| 4,799,827 | A | | 1/1989 | Jaqua |
| 4,819,967 | A | | 4/1989 | Calder et al. |
| 4,911,245 | A | | 3/1990 | Adamek et al. |
| 4,919,454 | A | | 4/1990 | Caulfield et al. |
| 4,932,472 | A | | 6/1990 | Boehm, Jr. |
| 4,949,786 | A | | 8/1990 | Eckert et al. |
| 4,960,172 | A | | 10/1990 | Nelson |
| 4,995,464 | A | * | 2/1991 | Watkins et al. ..... 166/382 |
| 5,067,734 | A | | 11/1991 | Boehm, Jr. |
| 5,090,737 | A | * | 2/1992 | Brammer et al. ..... 285/39 |

(Continued)

FOREIGN PATENT DOCUMENTS

| | | |
|---|---|---|
| EP | 0418056 B1 | 11/1995 |
| GB | 2235229 A | 2/1991 |
| GB | 2450408 A | 12/2008 |

OTHER PUBLICATIONS

U.S. Appl. No. 13/706,179, filed Dec. 5, 2012, entitled: Packoff Sealing Assembly.

(Continued)

*Primary Examiner* — James Sayre
(74) *Attorney, Agent, or Firm* — Bracewell & Giuliani LLP

(57) ABSTRACT

An adjustable casing sub having an outer housing, an inner housing insertable into the outer housing, and a ratcheting system for coupling the inner housing within the outer housing. An annulus is between a portion of the inner and outer housing, the annulus including an inwardly tapered section. A metal faced seal is disposed in the annulus, wherein the metal faced seal includes a sliding surface and a compressive sealing surface. The sliding surface may include a malleable inlay and the compressive sealing surface may include a spring like element. Moreover, the metal faced seal radial thickness is greater than the inwardly tapered section radial thickness.

6 Claims, 3 Drawing Sheets

(56) References Cited

U.S. PATENT DOCUMENTS

| | | | | |
|---|---|---|---|---|
| 5,285,853 | A | 2/1994 | Eckert et al. | |
| 5,299,642 | A | 4/1994 | Nelson et al. | |
| 5,311,947 | A | 5/1994 | Kent et al. | |
| 5,450,904 | A | 9/1995 | Galle | |
| 5,456,314 | A | 10/1995 | Boehm, Jr. | |
| 5,551,803 | A | 9/1996 | Pallini, Jr. et al. | |
| 5,566,761 | A | 10/1996 | Pallini, Jr. et al. | |
| 5,671,812 | A | 9/1997 | Bridges | |
| 5,685,369 | A | 11/1997 | Ellis et al. | |
| 5,878,816 | A | 3/1999 | Lalor et al. | |
| 6,045,296 | A | 4/2000 | Otten et al. | |
| 6,234,252 | B1 | 5/2001 | Pallini, Jr. et al. | |
| 6,293,343 | B1 | 9/2001 | Pallini, Jr. et al. | |
| 6,367,558 | B1 | 4/2002 | Borak, Jr. | |
| 6,565,093 | B2 * | 5/2003 | Crow et al. | 277/337 |
| 7,112,011 | B2 | 9/2006 | McCarty et al. | |
| 7,331,395 | B2 | 2/2008 | Fraser et al. | |
| 7,337,848 | B2 | 3/2008 | Fraser et al. | |
| 7,762,319 | B2 | 7/2010 | Nelson | |
| 7,861,789 | B2 * | 1/2011 | Nelson | 166/348 |
| 7,913,767 | B2 * | 3/2011 | Larson et al. | 166/380 |
| 8,146,670 | B2 | 4/2012 | Ellis et al. | |
| 8,186,426 | B2 | 5/2012 | Nelson | |
| 8,205,670 | B2 | 6/2012 | Nelson | |
| 8,312,922 | B2 | 11/2012 | Nelson | |
| 2006/0186602 | A1 * | 8/2006 | Martin et al. | 277/338 |
| 2008/0296845 | A1 * | 12/2008 | Doane | 277/337 |
| 2010/0038089 | A1 | 2/2010 | Gette et al. | |
| 2011/0316236 | A1 | 12/2011 | Gette et al. | |
| 2012/0025470 | A1 | 2/2012 | Gette | |
| 2012/0085554 | A1 | 4/2012 | Gette et al. | |
| 2012/0098203 | A1 | 4/2012 | Duong | |
| 2012/0118585 | A1 | 5/2012 | Duong | |
| 2012/0241175 | A1 | 9/2012 | Galle et al. | |
| 2012/0247788 | A1 | 10/2012 | Ford et al. | |
| 2013/0000920 | A1 | 1/2013 | Duong | |

OTHER PUBLICATIONS

U.S. Appl. No. 13/338,921, filed Dec. 28, 2011, entitled: "Metal-to-Metal Sealing Arrangement for Control Line and Method of Using Same".

U.S. Appl. No. 13/275,884, filed Oct. 18, 2011, entitled "Soft Skin Metal Seal and Technique of Manufacture".

U.S. Appl. No. 13/730,306, filed Dec. 28, 2012, entitled "Seal with Flexible Nose for Use with a Lock-Down Ring on a Hanger in a Wellbore".

U.S. Appl. No. 13/310,172, filed Dec. 2, 2011, entitled "Seal with Bellows Type Nose Ring".

U.S. Appl. No. 13/428,898, filed Mar. 23, 2012, entitled "Wellhead Assembly Having a Sinusoidal Sealing Profile and a Method to Assemble the Same".

U.S. Appl. No. 13/659,499, filed Oct. 24, 2012, entitled "Hard Stop Energizing Ring".

U.S. Appl. No. 13/644,914, filed Oct. 4, 2012,entitled "Semi-Rigid Lockdown Device".

U.S. Appl. No. 13/678,166, filed Nov. 15, 2012, entitled "Slotted Metal Seal".

U.S. Appl. No. 13/612,062, filed Sep. 12, 2012, entitled "Annulus Seal with Stepped Energizing Ring".

Search Report, Application No. GB 0911297.0, dated Oct. 7, 2009.

* cited by examiner

METAL SEALING ADJUSTABLE CASING SUB

RELATED APPLICATIONS

This application is a divisional of and claims priority to and the benefit of co-pending U.S. application Ser. No. 12/171,051 filed Jul. 10, 2008, the full disclosure of which is hereby incorporated by reference herein.

BACKGROUND

1. Field of Invention

The device described herein relates generally to the production of oil and gas. More specifically, the device described herein relates to a sealing assembly for use in an adjustable casing sub.

2. Description of Related Art

Some offshore platforms have a production tree or trees above the sea surface on the platform. In this configuration, a casing string extends from the platform housing to a subsea wellhead housing disposed on the seafloor. Production casing inserted within the wellbore is supported on the subsea floor by a hanger in the subsea housing. The casing string between the subsea and surface wellhead housings is tensioned to prevent flexure that may be caused by thermal expansion from heated wellbore fluids or vibration from applied side loads. Additionally, the string length or height is typically adjusted to seat or land the upper casing within a surface hanger.

A sub assembly can be attached to the casing string and used to tension the casing string and adjust its length. The sub assemblies typically comprise a pair of mated housings that in response to an applied force are mechanically retractable in length The adjustable sub assemblies connect inline within the string or on its upper end and when retracted impart a tension force on the casing string and by its retraction, shortening the casing string length.

SUMMARY OF INVENTION

The present disclosure includes a tubular assembly extending between a platform and a subsea wellhead. In an embodiment the tubular assembly includes a casing string connected to the subsea wellhead and an adjustable casing sub coupled between the casing string and the platform. The adjustable casing sub comprises an outer housing, an inner housing selectively insertable within the outer housing, and an annulus formed between the inner and outer housings. At least one of the housings has a seal surface in the annulus. A seal is provided that moves from an initial "clearance" position to a sealing position in the annulus adjacent the seal surface. The seal may have a metal face, the face having an interfering diameter with the seal surface causing radial deformation of the seal as it moves axially within the annulus. Also included is a seal energizing system.

The metal face may be a ductile metal and may be one of a silver coated metal, a eutectic alloy, an indium alloy, and combinations thereof. The compressive sealing surface may be a spring like element. The seal on a side opposite the metal face can include a resilient cantilevered member having a sealing surface on its free end that engages the other side of the housing. In one embodiment, the seal face is in sealing contact with the outer housing inner circumference. A plurality of seal elements of a soft ductile metal may be included on the seal face. The housing surface may include a transition circumscribing an axis of the adjustable casing sub, the transition defining a change in diameter of the housing, wherein on one side of the transition a clearance exists between the seal and the housing, and the other side of the transition defines the seal surface where the seal is put into interfering and sealing engagement with the seal surface. The transition may be on the outer diameter of the inner housing, or on the inner diameter of the outer housing.

The seal, in one embodiment, has an elongate height aligned with the casing sub axis, the seal face comprising bands of ductile metal inlays coaxially circumscribing the body outer surface, the inlays in sliding contact with the outer housing inner surface, and the seal has an opposite side containing a sealing surface disposed on the end of a spring like cantilever member, the elastic deformable sealing surface compressively engagable with the outer circumference of the inner housing.

Also disclosed herein is a well production apparatus comprising a first housing and a second housing coaxially and telescopingly engaged with the first housing with an improved seal between the housings. The seal comprises a radial seal body circumscribing an axis, the body having an elongate section aligned with the axis, elastically deformable cantilevered arms extending from the respective ends of the elongate section, sealing members extending from the end of the cantilevered arms configured for sealing engagement with one of the housings on a first side of the seal body, and a plurality of ductile metal inlays on a side of the seal body opposite to the first side. A transition is formed on one of the housings defining a transition to a sealing surface on the housing. The seal body is radially stretched when in contact with the sealing surface to put the seal members in sealing contact with the sealing surface.

The present disclosure also include an adjustable casing sub, the sub including an upper end mechanically couplable to a platform, a lower end mechanically couplable to a casing string, a first housing, a second housing, wherein the housings are telescopingly insertable within one another, an energizing sleeve provided within one of the housings, elongated splines formed on the energizing sleeve inner diameter for rotating the energizing sleeve, a change in diameter radially circumscribing one of the housings defining a transition from a clearance portion to a sealing surface on the housing, a radial annulus between the first and second housing extending across the transition, and a radial seal disposed in the annulus and axially moveable therein, and the seal energized into sealing engagement with the sealing surface when urged past the transition from the clearance portion.

BRIEF DESCRIPTION OF DRAWINGS

Some of the features and benefits of the present invention having been stated, others will become apparent as the description proceeds when taken in conjunction with the accompanying drawings, in which.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

The device described herein provides a metal seal for use in an adjustable casing sub. The metal seal includes a compressible surface having a ductile metal insert that is also lubricating when axially sliding along an opposing sealing surface. The seal may also include an elastically deformable member on the opposing side of the compressible surface that elastically deforms under a compressive load, and due to its elasticity imparts a sealing force on its respective sealing surface.

Figure 1:
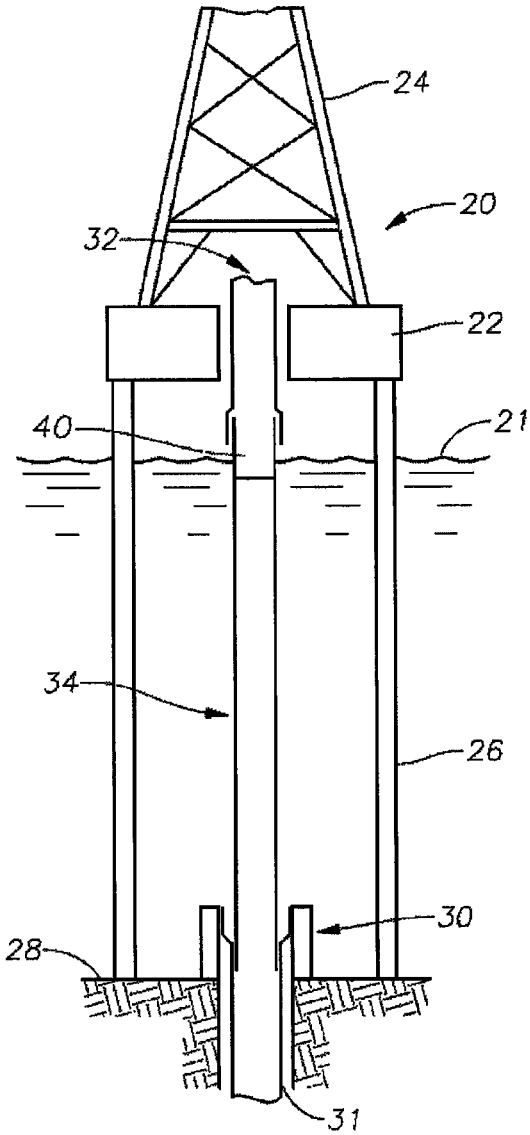
FIG. 1 is a side view of an offshore rig with a casing string extending to the seafloor, the casing string having an adjustable casing sub.

With reference now to FIG. 1, an example of an offshore rig 20 is provided in a side view. The offshore rig 20 includes a platform 22 situated above the level of the sea 21 with a derrick structure 24 attached to the top of the platform 22. Support legs 26 extend from the bottom of the platform and attach on the sea floor 28. A subsea wellhead 30 is formed over a wellbore 31. A tieback casing string 34 extends upward from the subsea wellhead and is coupled with a surface wellhead 32 that is within the platform 22 of the offshore rig 20. In line with the casing string 34 is an adjustable casing sub 40. As is known, insertion of the adjustable casing sub 40 can adjust the length of the casing string 34 to a predetermined length and can also tension the casing string 34.

Figure 2:
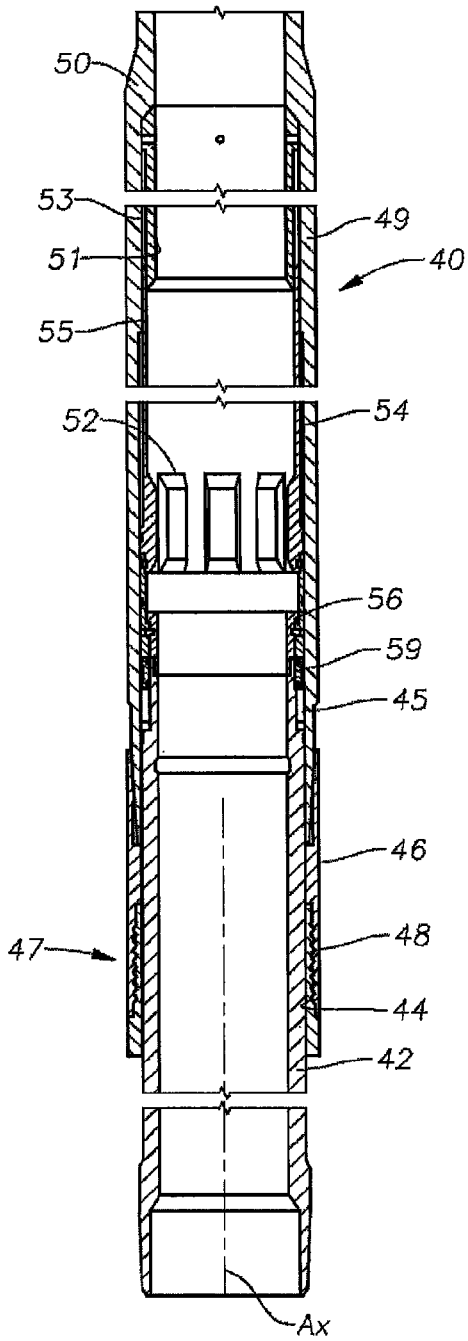
FIG. 2 is a side cutaway view of an embodiment of an adjustable casing sub.

A partial cross-sectional view of an example of an adjustable casing sub 40 is shown in FIG. 2. The adjustable casing sub is made up of a generally annular inner housing body 42 that partially coaxially extends into an outer sleeve 50. The outer sleeve 50 is an annular member with its inner diameter roughly equal to the outer diameter of the inner housing body 42. These respective dimensions allow insertion and telescoping coaxial movement of the inner housing body 42 within the outer sleeve 50. A ratchet ring housing 46 is attached to the lower terminal end of the outer sleeve 50. The ratchet ring housing 46, which is also annular, coaxially circumscribes a portion of the inner housing body 42 below the terminal end of the outer sleeve 50. Teeth 48 are provided on the inner circumference of the ratchet ring housing 46 on its lower skirt section. A ratchet ring 44 is formed on the outer circumference of the inner housing body 42 and profiled on its outer surface with teeth corresponding to the teeth 48 on the ratchet ring housing 46. The combination of ratchet ring housing 46 and ratchet ring 44 make up a ratchet assembly 47 that permits movement of the ratchet ring housing 46 downward or away from the outer sleeve 50 while preventing upward movement of the ratchet ring housing 46.

An annular traveling sleeve 54 is coaxially affixed within a portion of the outer sleeve 50. The traveling sleeve 54 is profiled on its inner circumference and at its lower end, in the embodiment illustrated the profiles include elongated torque splines 52. The splines 52 extend generally parallel to the axis $A_X$ of the adjustable casing sub 40. Also coaxially disposed within the outer sleeve 50 is an annular fixed sleeve 51 having an outer diameter less than the inner diameter of the traveling sleeve 54. The dimensions of the fixed sleeve 51 and the outer sleeve 50 form an annulus 49 therebetween. Threads 55 are formed on the outer circumference of the upper end of the traveling sleeve 54, and corresponding threads 53 are formed on the outer diameter of the fixed sleeve 51.

The respective inner and outer diameters of the inner housing body 42 in the outer sleeve 50 form a housing annulus 45 between these two members. The annulus 45 is an annular void with a seal assembly 59 disposed therein. The seal assembly 59 includes a metal sealing face in contact with one of either the inner or outer housings to seal the coupling connection between the inner housing body 42 and outer sleeve 50. The embodiment of FIG. 2 also illustrates an energizing sleeve 56 for urging the seal assembly 59 into an energized sealing configuration.

Figure 3:
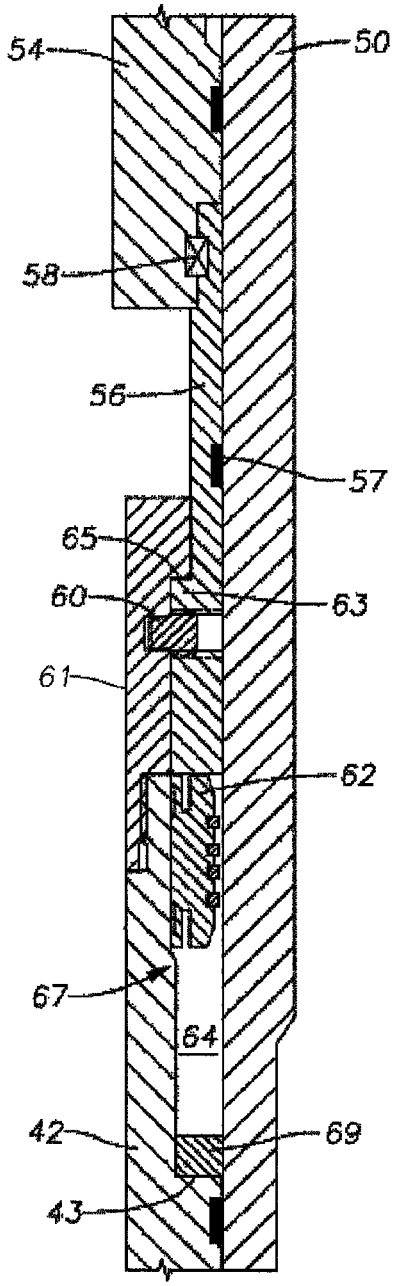
FIG. 3 is a side cross sectional view of a seal for an adjustable casing sub prior to being energized.

FIG. 3 provides a side cross-sectional view of an embodiment of a seal assembly. In this figure, the lower end of the traveling sleeve 54 connects to the energizing sleeve 56 via a locking element 58. In this embodiment, the locking element 58 has a split ring compressed into respective channels formed in the traveling sleeve 54 and the energizing sleeve 56. The energizing sleeve 56 is illustrated as a ring-like member extending around the lower circumference of the traveling sleeve 54. A sealing element 57 may optionally be provided in a space between the outer surface of the energizing sleeve 56 and the inner radius of the outer sleeve 50. In this embodiment, the energizing sleeve 56 outer diameter is substantially the same as the outer sleeve 50 inner diameter. The energizing sleeve 56 and outer sleeve 50 are in sliding contact.

The energizing sleeve 56 lower portion terminates in an inwardly directed lip 63 that extends away from the outer sleeve 50. An inner housing nut 61 is shown coaxially adjacent within the lower portion of the energizing sleeve 56. The inner housing nut 61 is a largely annular member having a shoulder formed on its upper end that extends outward toward the outer sleeve 50 to form a cooperating surface with the lip 63 on the lower end of the energizing sleeve 56. The lower terminal end of the inner housing nut is threadingly coupled to the upper terminal end of the inner housing body 42. A shear pin 60 radially extends inward from the energizing sleeve 56 outer diameter to the inner housing nut outer diameter. The shear pin 60 is disposed below the point where the lip 63 and the shoulder 65 are coupled.

Figure 5:
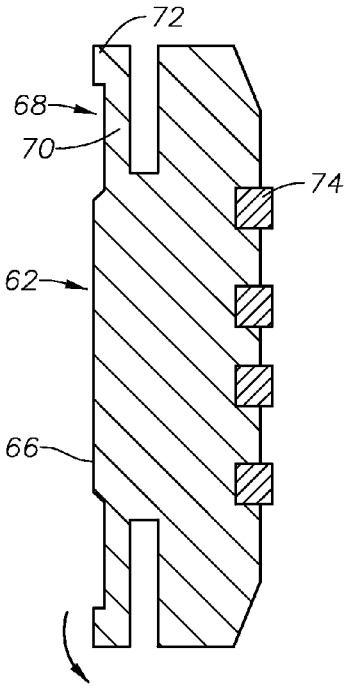
FIG. 5 is a side cross sectional view of an embodiment of a seal for use in an adjustable casing sub.

An annular seal pocket 64 is shown radially disposed between the outer diameter of the inner housing body 42 and the inner circumference of the outer sleeve 50. The annular seal pocket 64 axially extends on one end from the outer sleeve 50 to a radial ledge 43 in the inner housing body 42 radially extending outward to the inner radius of the outer sleeve 50. An optional ring seal 69 is shown disposed in the annular seal pocket 64 adjacent the radial ledge 41 A seal 62 is shown positioned within the annular seal pocket 64; a side cross-sectional view of an embodiment of the seal 62 is illustrated in FIG. 5. The seal 62 of FIG. 5 include a seal body 66, cantilever members 68 shown on an inner diameter, and metal inlays 74 depicted on an outer surface of the seal 62. The body 66 has an elongate height with respect to its thickness, and in the embodiment of FIG. 3 the elongate portion is largely parallel to the axis of the adjustable casing sub 40. The cantilever members 68 have elongate cantilever legs 70 having sealing members 72 on their free end. The sealing members 72 face away from the body 66.

The body 66 and cantilever members 68 may be include materials such as stainless steel, titanium, or any elastically deformable material capable of withstanding an applied distributed force without permanently deforming. In one example of use, the force is about 40,000 lbf/in$^2$, and another embodiment the force is about 30,000 lbf/in$^2$, and yet another embodiment the force is about 25,000 lbf/in$^2$. The metal inlays 74 are made up of a soft ductile metal plastically deformable upon applied sealing loads. Moreover, the inlays 74 should compress when the seal 62 placed in sealing engagement. In one optional embodiment, the metal inlays 74 also provide lubricity such that when sliding across an opposing sealing surface the resultant coefficient of friction is less than that if the metal inlay 74 were made from a less ductile or harder material. Examples of soft metal candidates include lead, copper, silver, gold, zinc, and alloys thereof. The inlays 74 can be all soft metal, or be a harder material having a film, coating, or plating having a soft metal.

Figure 4:
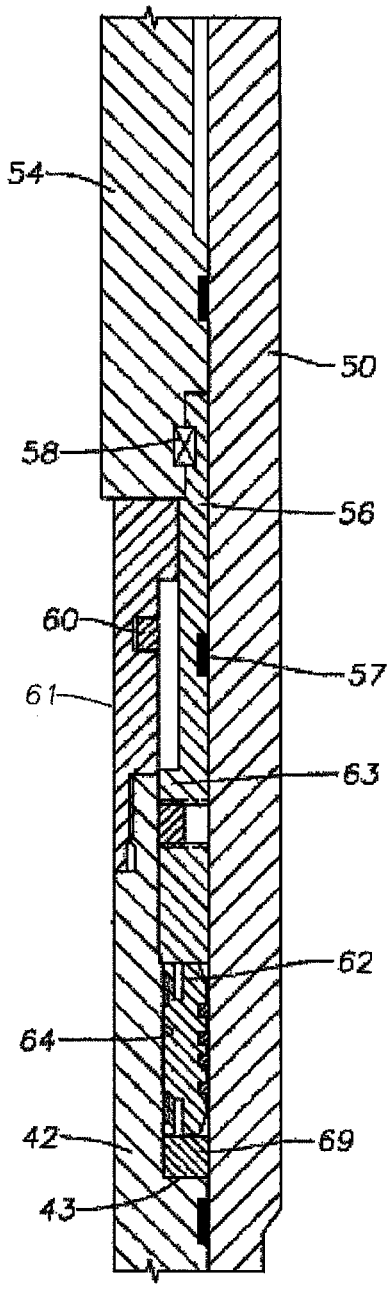
FIG. 4 is a side cross sectional view of the seal of FIG. 3 after being energized.

Referring again to FIG. 3, a transition 67 on the inner housing body 42 identifies a change in diameter of the inner housing body 42. Preferably, the inner housing body 42 outer diameter between the transition 67 and the energizing sleeve 56 does not exceed the seal 62 inner diameter. This allows clearance for the seal 62 when in the portion of the annular seal pocket 64 between the transition 67 and the energizing sleeve 56. The annular seal pocket 64 cross-section or thickness reduces between the transition 67 and the radial ledge 43. As seen in FIG. 4, the dimensional change in the annular seal pocket 64 at the transition 67 results in an interference fit when moving the seal 62 between the transition 67 and the radial ledge 43. The interference fit energizes the seal 62 when it is urged into the portion of the annular seal pocket 64 between the transition 67 and the radial ledge 43. When the seal 62 is in the interference position the body 66 is radially stretched. The increased inner housing body 42 diameter past the transition 67 contacts the sealing members 72 to elastically deform the cantilever legs 70. The elastic deformation produces an opposing sealing force between the sealing members 72 and the inner housing body 42 outer circumference to form a seal between these two surfaces. Additionally, the increased inner housing body 42 diameter also radially urges the inlays 74 against the outer sleeve 50 inner circumference. This plastically deforms the inlays 74 to form a sealing surface between the metal inlays 74 and the outer sleeve 50.

Radially stretching the seal 62 around the increased diameter of the inner housing body 42 effectively increases the seal diameter to actively engage the mating seal surface on the seal 62 inner and outer diameters. Optionally, the side of the seal 62 having the metal inlay 74 and the side having the cantilever 68 may be reversed such that the metal inlays 74 are in contact with the outer circumference of the inner housing body 42 and the cantilevers 68 and their respective sealing members 72 are in contact with the outer sleeve 50 inner circumference.

With respect to the adjustable casing sub 40, the seal 62 may be energized prior to or after tensioning. In one example of use, the casing sub 40 is secured on its lower end to the casing string 34 and an upper portion of the casing sub 40 is attached to a section having a hanger to be landed within the surface wellhead 32. After engaging the ratchet ring housing 46 over the ratchet ring 44, the casing string is further tensioned by an inserted running or torque tool (not shown) within the casing string and in engagement with the torque splines 52. The tool rotates the torque splines 52 and traveling sleeve 54 counter-clockwise engaging the threads 55 on the traveling sleeve 54 with the threads 53 on the outer sleeve 50. Energizing ring 56 does not rotate with the traveling sleeve 54. Since the traveling sleeve 54 is coupled with the inner housing body 42, as previously described, upwardly moving the traveling sleeve 54 pulls the inner housing body 42 upward to tension the casing string. When a desired amount of tension in the string has been reached the running tool rotation may be reversed, thereby downwardly motivating the traveling sleeve 54 within the outer housing 50 to set or energize the seal 62.

The locking interaction between the ratchet ring 44 and the ratchet ring housing 46 prevents inner housing body 42 movement relative to the outer sleeve 50 when downwardly motivating the traveling sleeve 54. Instead, continued downward force will fracture the shear pin 60, thereby allowing energizing sleeve 56 downward movement with respect to the inner housing nut 61 without rotation. As previously noted, traveling sleeve 54 upward movement does not apply a shear force to the shear pin 60 due to the inner locking connection between the lip 63 and shoulder 65. Continued downward movement of the energizing sleeve 56 urges the seal 62 within the annulus 64 below the transition 67, as shown in side view in FIG. 4. Whether or not the step of energizing the seal 62 occurs prior to tensioning the casing string or after tensioning, at some point a sliding action will occur between the seal 62 and a sealing surface of either the outer sleeve 50 or the inner housing body 42. Accordingly, the ductile and lubricating effect of the metal inlay is operative in either scenario of operation.

The cantilever member is not limited to the embodiment illustrated in the figures, but can include any elastically deformable configuration. In addition to being radially stretched, the seal can be radially compressed to affect the energizing configuration. One of the advantages of the device described herein is the use of metal sealing without the need for any elastomer.

Figure 6:
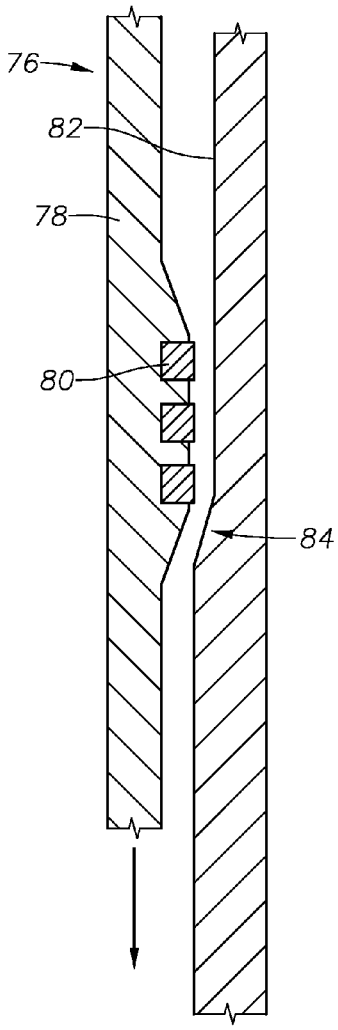
FIG. 6 is a side cross sectional view of an embodiment of a seal for an adjustable casing sub prior to being energized.
Figure 7:
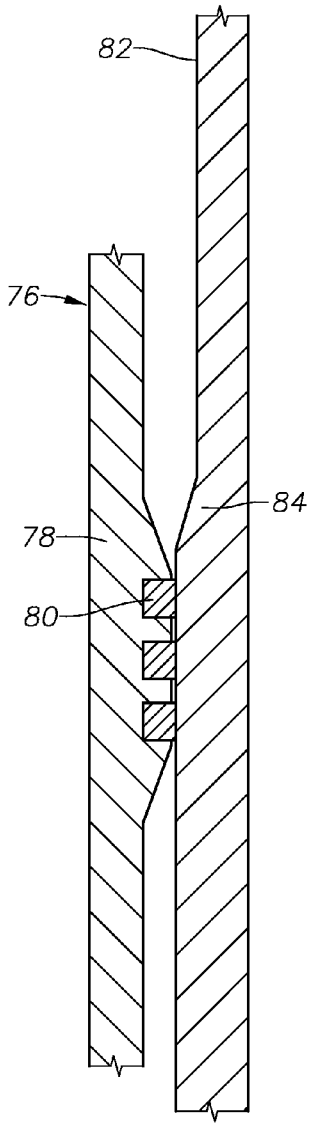
FIG. 7 is a side cross sectional view of the seal of FIG. 6 after being energized.

FIGS. 6 and 7 provide a side view of an alternative example of a seal for use in an adjustable casing sub. In this embodiment the seal is integral with either an inner or an outer housing. With reference now to FIG. 6, a portion of the inner housing body includes a seal assembly 76 where the seal assembly includes a mid-section 78 and inlays 80 disposed on one side of the mid-section 78. The outer housing includes an outer housing seal surface 82 with a radial transition 84 formed along a portion of the sealing surface 82. Additionally, the mid-section 78 of the seal assembly 76 is thicker than the housing. In FIG. 7, the inner housing body 42 has been coaxially telescopingly inserted within the outer sleeve 50, and the mid-section 78 has slid past the transition 84 and into a reduced diameter portion. Moving the seal assembly 76 below the transition 84 produces a compressive and sealing contact between the seal assembly 76 and the outer housing seal surface 82. Accordingly, in this configuration, an energized sealing surface between an inner housing and an outer housing can be formed integral with the step of tensioning within an adjustable casing sub.

It should be pointed out that in the configuration illustrated in FIGS. 6 and 7, the seal is not limited to being placed on the inner housing, but can be situated on the outer sleeve 50. When made part of the inner housing body 42 the sealing surface is radially compressed when put into the energizing situation. Conversely, when the seal is disposed on the outer sleeve it is radially expanded during sealing. The sliding seal being radially compressed or expanded generates stored energy that imparts an increased contact stress that is sufficient to create a metal-to-metal seal. Accordingly, embodiments exist wherein the metal seal has a bearing stress of between 5,000 pounds per square inch and 30,000 pounds per square inch. Based on particular applications, however, this sealing stress can be increased.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

What is claimed is:

1. In a well production apparatus, a first housing and a second housing coaxially and telescopingly engaged with the first housing, an improved seal between the housings comprising:

a radial seal body circumscribing an axis, the body having an elongate section aligned with the axis;

elastically deformable cantilevered arms extending from respective ends of the elongate section;

sealing members extending from the ends of the cantilevered arms configured for sealing engagement with one of the housings on a first side of the seal body; and a plurality of ductile metal inlays on a second side of the seal body opposite to the first side.

2. The seal of claim 1, further comprising a change in a diameter of one of the housings, defining a transition to a sealing surface on said one of the housings.

3. The seal of claim 2 wherein the seal body is radially stretched when in contact with the sealing surface to put the sealing members in sealing contact with the sealing surface.

4. The seal of claim 3, wherein the first housing extends within the second housing, the transition is on the first housing outer diameter, and the ductile metal inlays are in sealing contact with the second housing inner diameter.

5. The seal of claim 3, wherein the second housing extends within the first housing, the transition is on the first housing inner diameter, and the ductile metal inlays are in sealing contact with the second housing outer diameter.

6. The seal of claim 1, wherein the seal is a ring like member and which is selectively moved from an upper configuration, to a lower configuration, wherein in the lower configuration an outer diameter of an inner one of the housings increases thereby flexing the cantilever member radially outward.

* * * * *